United States Patent [19]

Blanding et al.

[11] Patent Number: 4,773,346

[45] Date of Patent: Sep. 27, 1988

[54] HYDRAULIC BOAT LIFT

[76] Inventors: Douglass L. Blanding, 185 Beaconview Ct., Rochester, N.Y. 14617; Wendell S. Blanding, 115 Keefe Blvd., Painted Post, N.Y. 14870

[21] Appl. No.: 35,857

[22] Filed: Apr. 8, 1987

[51] Int. Cl.[4] ..... B63C 1/08

[52] U.S. Cl. ..... 114/45; 114/48; 405/3; 405/4

[58] Field of Search ..... 114/44, 45, 48, 52, 114/258, 270; 405/1-5

[56] References Cited

U.S. PATENT DOCUMENTS

| | | | |
|---|---|---|---|
| 2,505,832 | 5/1950 | Lange | 61/65 |
| 3,177,668 | 4/1965 | Schneider et al. | 61/65 |
| 3,276,211 | 10/1966 | Drake | 114/45 |
| 3,559,606 | 2/1971 | Gregory | 114/44 |
| 3,841,441 | 10/1974 | Klinkhammer et al. | 61/65 |
| 3,857,248 | 12/1974 | Rutter | 61/65 |
| 4,195,948 | 4/1980 | Vancil | 405/3 |
| 4,280,429 | 7/1981 | Wells | 114/45 |
| 4,686,920 | 8/1987 | Thomas | 114/45 |

*Primary Examiner*—Sherman D. Basinger
*Assistant Examiner*—Stephen P. Avila
*Attorney, Agent, or Firm*—Burton R. Turner

[57] ABSTRACT

The present invention sets forth an hydraulically operated boat lift for lifting small boats upwardly out of a body of water by simultaneously supplying water pressure to four support posts connected to four corner portions of a lifting frame. Each of the corner posts comprises an hydraulic cylinder with the cylinder body connected to the lifting frame and moveable vertically on its downwardly extending piston rod which forms support legs for the lift.

16 Claims, 2 Drawing Sheets

HYDRAULIC BOAT LIFT

BACKGROUND OF THE INVENTION

This invention relates to an hydraulic boat lift for lifting a small boat out of the water when not in use and safely supporting such boat above the surface of the water. In addition, the apparatus also lowers the boat gently into the water for use. More particularly, the invention relates to such a boat lift which is operated by water pressure supplied by a domestic water supply or a pump supplying water from the body of water in which the boat is moored.

It is frequently necessary, or desirable, that a boat owner elevate his craft above the surface of the water in which it is being used to protect the same during inclement weather, storms and the like, or to perform routine maintenance on the hull. Unfortunately, due to the complicated structure of conventional boat lifts, their expensiveness to fabricate, and the human energy which must be expended to operate the same, most boat owners have been unable to obtain a satisfactory boat lift which is not only easy to assemble but requires little exertion to operate.

Numerous boat lifts and floating platforms have been suggested in the past, as shown by U.S. Pat. Nos. 2,505,832 to Lange, 3,177,668 to Schneider et al., 3,559,606 to Gregory, 3,841,441 to Klinkhammer et al., 3,857,248 to Rutter, and 4,195,948 to Vancil. However, due to the complexity of such devices, and problems with their installation and operations, such devices have not been entirely satisfactory.

It thus has been an object of this invention to provide a mooring device for small boats, which device may rest upon the bottom of a lake or other body of water, such as alongside of a dock or the like, and which incorporates an hydraulically operated rectangular frame upon which a boat may be floated and thereafter lifted out of the water and held in a safe mooring position, wherein the boat is substantially unaffected by wave action.

SUMMARY OF THE INVENTION

In its simplest form, the present invention relates to an hydraulically operated boat lift consisting of a rectangular metal frame on which the boat rests while being lifted and held in an upper position out of the water. Four hydraulic cylinders are mounted to the rectangular metal frame, with one mounted in each of the four corners thereof. The cylinder body of each hydraulic cylinder, which may be made from PVC pipe, is mounted to the rectangular frame, which may be of aluminum, and the piston rod extends downwardly from the cylinder with adjustable extensions thereon, which provide legs for the lift, which rest on the bottom of the lake. Such extensions are adjustable so that they can rest on uneven or sloping lake bottoms and keep the frame in a level position.

DESCRIPTION OF THE PREFERRED EMBODIMENTS

Figure 1:
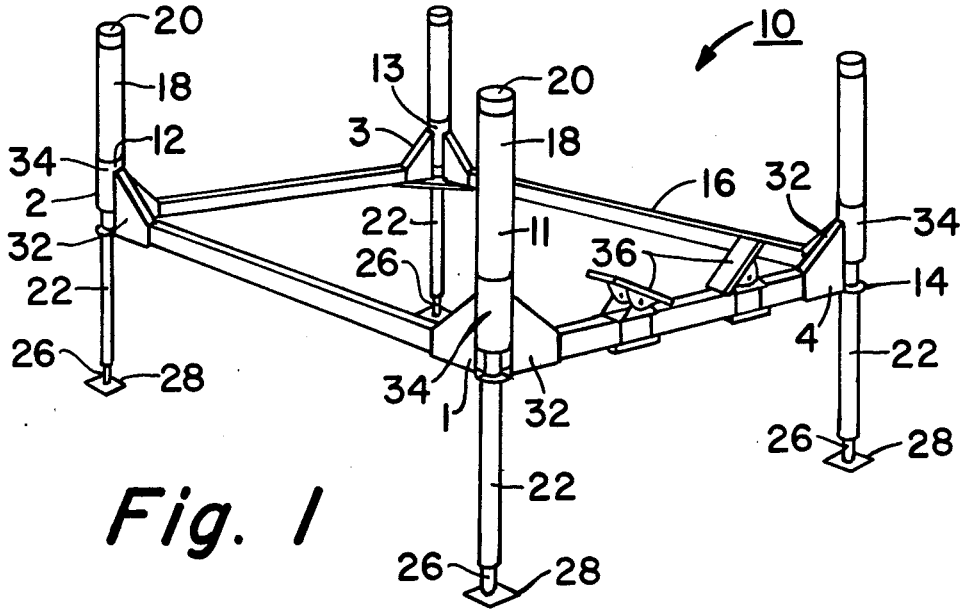
FIG. 1 is a perspective view of an hydraulic boat lift embodying the present invention.
Figure 2:
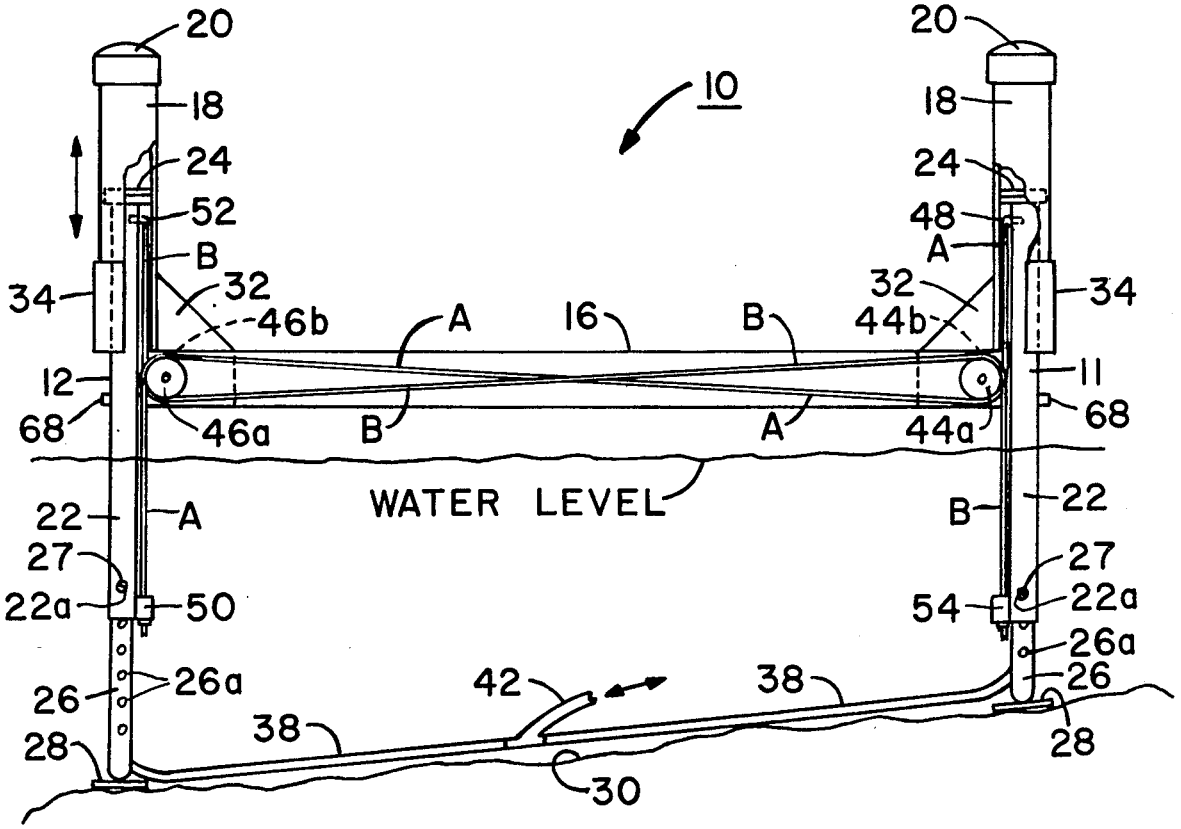
FIG. 2 is an elevational view, partially in section, of a side of the boat lift, in an "up" position.

Referring now particularly to FIGS. 1 and 2, an hydraulic boat lift 10 is shown comprising a rectangular metal frame 16 and four corner posts 11, 12, 13 and 14 secured to corners 1, 2, 3 and 4, respectively, of the rectangular metal frame 16. As shown more particularly in FIG. 2, the corner posts 11–14 each comprises a cylinder body 18 having an upper capped end 20, and a downwardly extending piston rod 22 having a piston 24 at its upper end within the cylinder body 18, and an adjustable extension 26 forming the legs of the posts 11–14. The cylinder rod 22 is provided with a key 23 along its extent. The bottoms of the legs 26 are provided with pivotal support feet 28 which rest upon, and conform to the slope of, the lake bottom 30. The legs 26, which slide within the hollow piston rods 22, are provided with a plurality of holes or apertures **26*a* which may be adjustably aligned with an opening 22*a*, formed in a lower portion of the piston rod, so that a suitable pin or bolt 27 positions the adjustable legs at a desired height to accommodate an uneven or sloping lake bottom, and keep the frame 16 in a level position as shown in FIG. 2**.

The rectangular frame 16 is secured to the bodies of the cylinders 18 by means of corner braces web brackets 32, each of which includes a support cylinder 34 secured to a cylinder body 18 such as by bolting or welding. In addition, pivotal support pads 36 may be provided on one or more of the end beams on frame 16 to accommodate and provide lateral support for the hull of a boat to be lifted.

Figure 3:
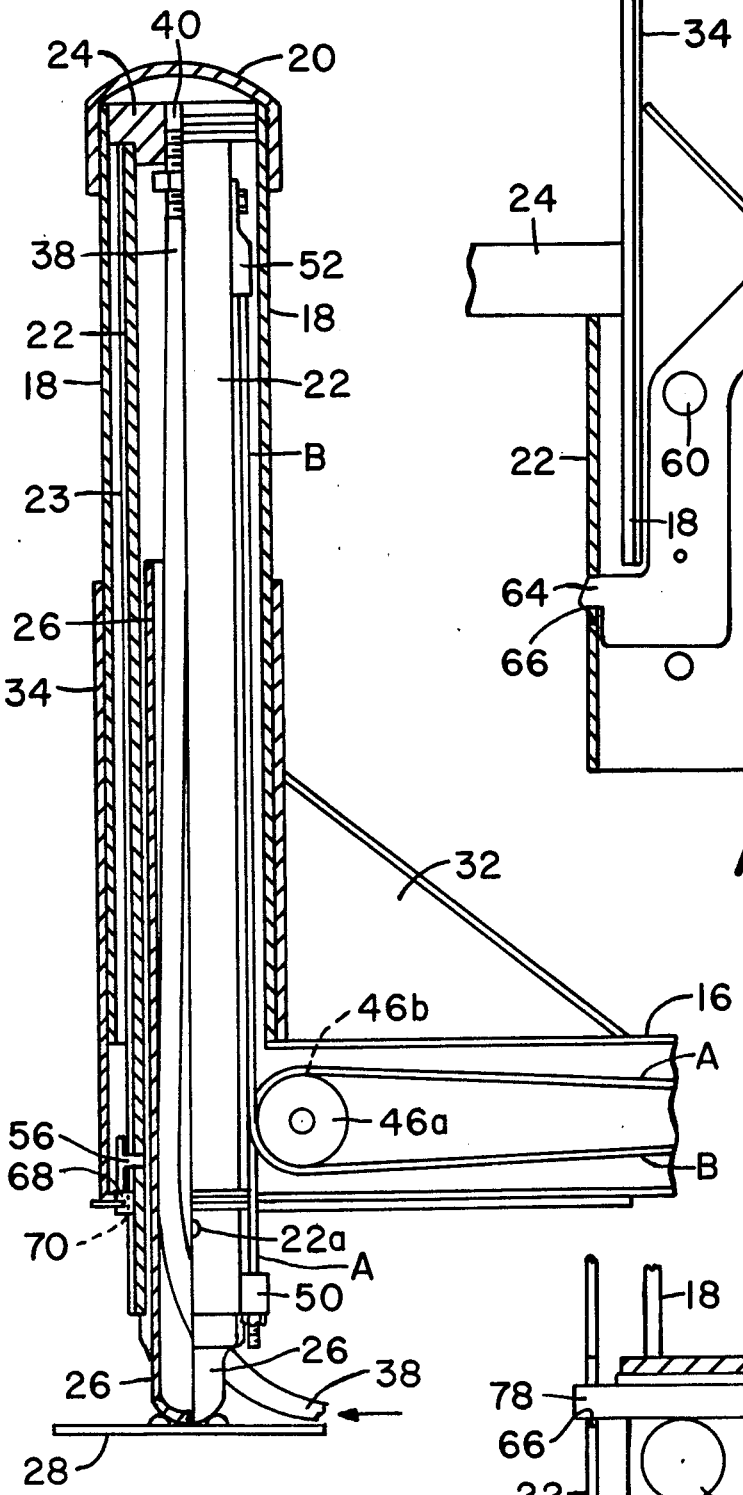
FIG. 3 is a fragmental sectional view of a cylinder and leg assembly in a "down" position.

Referring now to FIGS. 2 and 3, a water supply line 38 extends up each of the corner posts 11–14 and communicates with the upper capped end of each cylinder 18 by means of a threaded aperture 40 extending through the piston 24. An inlet and exhaust connector line 42 communicates with a suitable three-way valve (not shown) conveniently positioned on the side of the boat lift 10 adjacent a loading dock. To raise the frame 16, water is supplied to each of the four cylinders 18 simultaneously through water supply lines 38 into the base of the legs 26 and up through the piston rods 22 and through the aperture 40 in pistons 24 into the cylinders 18. The water supply, which may be from a garden hose or a pump from the lake or river on which the boat is moored, is controlled by the three-way valve. To raise the lift, the three-way valve directs the water into the hose system 38 and accordingly simultaneously into all four cylinders 18. When the desired height is obtained, the three-way valve is closed and the frame 16 is stopped, and locked in such position as described hereinafter. When the three-way valve is put in its exhaust position, the weight of the frame and the boat, due to gravity, causes a pressure in the cylinders to be higher than the exhaust, causing the water to flow from the cylinders through the exhaust connector line 42, thus allowing the frame and the boat to descend into the water.

Again, referring to FIGS. 2 and 3, one portion of a three-part leveling device is illustrated, with it being understood that the remaining two parts of the leveling device are identical. A first cable A is shown connected at one end 48 to an upper portion or piston end of a first piston rod 22. A pair of coaxial idler pulleys 44*a*, 44*b* are mounted on the frame 16 adjacent the first piston rod, and a second pair of idler pulleys 46*a*, 46*b* are coaxially mounted on the same side of frame 16 as idler pulleys 44*a*, 44*b*, but adjacent a second piston rod 22. Cable A leads down around pulley 44*a*, and then over pulley 46*a* and down to a lower cable connection 50 at the leg end of the second piston rod 22 in an adjacent corner of the frame 16. A second cable B is attached at 52 to the piston end of the second piston rod. Cable B then leads down around and under pulley 46*b* and up over pulley 44*b* and then leads down to a connection 54 at the lower or leg end of the first piston rod 22. Both cables A and B are of equal length, so as to guarantee that the frame rail 16 will at all times be parallel to a line extending perpendicularly between the axis of the two pistons. As shown in FIG. 3, a stop plate 56, which abuts against a lower flange portion of the cylinder body, is attached to an upper portion of the cylinder rod 22 to limit the upward movement of the cylinder body 18.

The description of the leveling cable system of FIG. 2 is actually the cable system which exists between corner 1 and corner 2 as shown in FIG. 1. As previously mentioned, it is understood that like systems are utilized between corner 2 and corner 3, and also between corner 3 and corner 4. When the four corners are interconnected in this manner, it insures that the plane of the frame is always level and parallel to a plane passing through all four pistons 24, regardless of the weight distribution on each of the four corners or cylinders. During both the raising and the lowering operations, the leveling cable system assures that the frame 16 and the cylinders 18 will rise or fall at the same rate, thus avoiding a binding or twisting of the frame on the corner posts 11–14.

Figure 4:
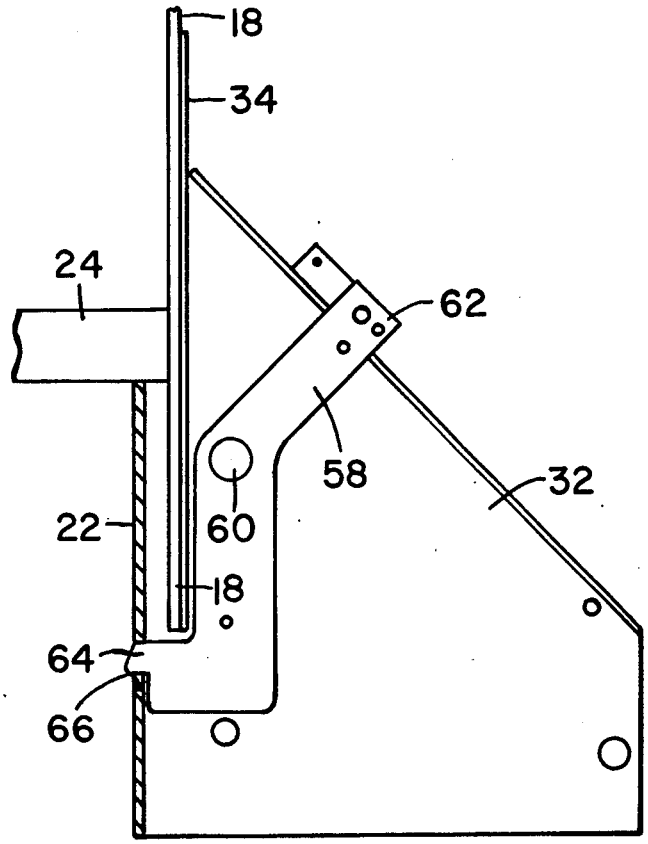
FIG. 4 is a schematic fragmental sectional view illustrating a locking latch for the cylinder and piston operation.

Referring now to FIG. 4, a corner latch 58 is shown for locking the piston rod 22 with respect to the cylinder body 18 in position when the frame 16 and the boat are in the up position, such as shown in FIG. 2. The corner latch 58 is pivoted to a corner web bracket 32 by means of a pivot pin 60, and has a handle portion 62 and a locking nose portion 64 which projects beneath the cylinder body 18 and into an opening 66 within the piston rod 22 to lock and hold the frame in the up position, when the water pressure is released. It is preferable to utilize two of such latches, one in corner 1 and one in corner 4, with the latches interconnected with a small cable so that they may be operated together and held in a retracted position when the latch operation is not needed.

Figure 5:
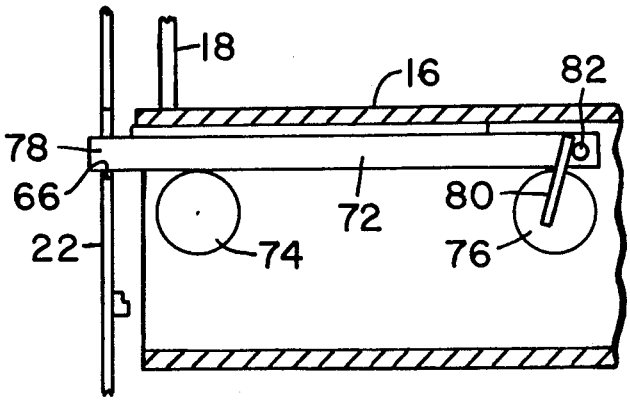
FIG. 5 is a schematic fragmental sectional view illustrating another embodiment of a locking latch.

Referring now to FIG. 5, a sliding corner latch 72 is shown which is supported on rollers 74, 76, rotatably mounted on frame 16. The sliding corner latch has a nose portion 78 which engages an opening 66 in the piston rod 22 to lock and hold the frame in the up position. The latch 72 is spring biased toward the piston rod, but may be held in an inoperative position when not needed by a handle 80 engaging pin 82.

As shown more particularly in FIG. 2, a bushing 68, having a keyway 70, is attached to the bottom of each cylinder body 18 for stabilizing the vertical movement along piston rods 22. That is, the key 23 of piston rod 22 slides within the keyway 70 of bushing 68 to maintain the orientation of the piston rod so that the opening within the rod are in correct rotational position.

Although we have described the now preferred embodiments of our invention, it will be understood that various changes and modifications may be made thereto without departing from the spirit and scope thereof as defined in the appended claims.

We claim:

1. An improved hydraulically operated boat lift operable on residentially supplied water pressure which comprises:

a rectangular lifting frame having four corners;

a corner post secured to each of the corners of said rectangular frame, each of said corner posts including an hydraulic cylinder comprising a cylinder body secured to one corner of said frame and a hollow piston rod extending downwardly from said cylinder body forming legs for supporting said rectangular frame on a bottom surface;

adjustable extension means connected to each said piston rod for positioning said rectangular lifting frame in a horizontal plane;

a piston secured to the upper end of each hollow piston rod within said cylinder body, and means for simultaneously supplying water under pressure through each of said hollow piston rods and through each said piston to said cylinder body for raising said cylinder bodies on said piston rods and accordingly raising said rectangular lifting frame;

leveling cable means connected between a first and second corner piston rod, between a second and third corner piston rod, and between a third and fourth corner piston rod for maintaining the plane of said frame parallel to a plane passing through said four pistons and thus assure free and unobstructive movement of said frame along said piston rods; and said adjustable extension means including extension members extending upwardly within each of said piston rods, a plurality of apertures formed in each of said extension members, an opening extending through each of said piston rods, and pin means extending through aligned apertures and openings for adjustably positioning said extension members on said piston rods.

2. An improved hydraulically operated boat lift operable on residentially supplied water pressure which comprises:

a rectangular lifting frame having four corners;

a corner post secured to each of the corners of said rectangular frame, each of said corner posts including an hydraulic cylinder comprising a cylinder body secured to one corner of said frame and a hollow piston rod extending downwardly from said cylinder body forming legs for supporting said rectangular frame on a bottom surface;

adjustable extension means connected to each said piston rod for positioning said rectangular lifting frame in a horizontal plane;

a piston secured to the upper end of each hollow piston rod within said cylinder body, and means for simultaneously supplying water under pressure through each of said hollow piston rods and through each said piston to said cylinder body for raising said cylinder bodies on said piston rods and accordingly raising said rectangular lifting frame;

leveling cable means connected between a first and second corner piston rod, between a second and third corner piston rod, and between a third and fourth corner piston rod for maintaining the plane of said frame parallel to a plane passing through said four pistons and thus assure free and unobstructive movement of said frame along said piston rods; and said leveling cable means including a pair of cables each connected at one end to an upper piston end of an adjacent corner piston rod and at their opposite ends to a lower leg end of the adjacent corner piston rod.

3. An improved hydraulically operated boat lift operable on residentially supplied water pressure which comprises:

a rectangular lifting frame having four corners;

a corner post secured to each of the corners of said rectangular frame, each of said corner posts including an hydraulic cylinder comprising a cylinder body secured to one corner of said frame and a hollow piston rod extending downwardly from said cylinder body forming legs for supporting said rectangular frame on a bottom surface;

adjustable extension means connected to each said piston rod for positioning said rectangular lifting frame in a horizontal plane;

a piston secured to the upper end of each hollow piston rod within said cylinder body, and means for simultaneously supplying water under pressure through each of said hollow piston rods and through each said piston to said cylinder body for raising said cylinder bodies on said piston rods and accordingly raising said rectangular lifting frame;

leveling cable means connected between a first and second corner piston rod, between a second and third corner piston rod, and between a third and fourth corner piston rod for maintaining the plane of said frame parallel to a plane passing through said four pistons and thus assure free and unobstructive movement of said frame along said piston rods; and corner latch means for locking the piston and cylinder body in position when the frame is in an up position.

4. An improved hydraulically operated boat lift as defined in claim 3 wherein said corner latch includes a latch member movable on said frame and having a nose portion engageable with an opening in a piston rod to lock said rod in position and hold the frame in an up position when the water pressure is released.

5. An improved hydraulically operated boat lift which comprises:

a plurality of support posts;

a single frame member connected at corner positions to said support posts;

means forming a part of said support posts, for positioning said frame member in a horizontal position;

said frame member having a configuration with rectangularly positioned corner portions, and a support post secured to each such corner portion;

said support posts each comprising an hydraulic cylinder including a cylinder body secured, adjacent a lower extent thereof, to said frame member and a downwardly extending piston rod forming a support leg for said frame member;

means for simultaneously supplying water under pressure to an upper portion of each of said cylindrical bodies for raising said cylindrical bodies on said support leg piston rods and accordingly raising said single frame member supported by said support posts; and cable means interconnected between all of said support posts for maintaining said frame in a horizontal position and parallel to a line perpendicular to the axis of said piston rods during the raising and lowering of said frame member to prevent the twisting and binding thereof.

6. An improved hydraulically operated boat lift which comprises:

a plurality of support posts;

a lifting frame member supported by said support posts;

means, forming a part of said support posts, for positioning said frame member in a horizontal position;

said support posts each comprising an hydraulic cylinder including a cylinder body secured to said frame member and a downwardly extending piston rod forming a support leg for said frame member;

means for simultaneously supplying water under pressure to an upper portion of each of said cylinder bodies for raising said cylinder bodies on said support leg piston rods and accordingly raising said frame member;

cable means interconnected between all of said support posts for maintaining said frame in a horizontal position and parallel to a line perpendicular to the axis of said piston rods during the raising and lowering of said frame member to prevent the twisting and binding thereof; and said means for positioning said frame member in a horizontal position including an adjustable extension member adjustably connected to a lower end of each of said piston rods, such that the legs may rest upon an uneven lake bottom and maintain the frame member in a level horizontal position.

7. An improved hydraulically operated boat lift as defined in claim 6 wherein each of said adjustable extension members has a pivotal support foot at the lower end thereof for engaging and conforming to a bottom surface and supporting the lift thereon.

8. An improved hydraulically operated boat lift which comprises:

a plurality of support posts;

a lifting frame member supported by said support posts;

means, forming a part of said support posts, for positioning said frame member in a horizontal position;

said support posts each comprising an hydraulic cylinder including a cylinder body secured to said frame member and a downwardly extending piston rod forming a support leg for said frame member;

means for simultaneously supplying water under pressure to an upper portion of each of said cylinder bodies for raising said cylinder bodies on said support leg piston rods and accordingly raising said frame member;

cable means interconnected between all of said support posts for maintaining said frame in a horizontal position and parallel to a line perpendicular to the axis of said piston rods during the raising and lowering of said frame member to prevent the twisting and binding thereof; and a piston secured to the upper end of each of said downwardly extending piston rods, and each of said piston rods being hollow for receiving, in a lower end portion thereof, said means for positioning said frame member in a horizontal position.

9. An improved hydraulically operated boat lift as defined in claim 8 wherein said piston has an opening extending therethrough and wherein said means for simultaneously supplying water under pressure to an upper portion of said cylinder bodies includes water supply lines extending upwardly through said hollow piston rods and connected to the opening extending through said piston for supplying water under pressure simultaneously to the upper end of each of said cylinder bodies for raising said frame member.

10. An improved hydraulically operated boat lift which comprises:

a plurality of support posts;

a lifting frame member supported by said support posts;

means, forming a part of said support posts, for positioning said frame member in a horizontal position;

said support posts each comprising an hydraulic cylinder including a cylinder body secured to said frame member and a downwardly extending piston rod forming a support leg for said frame member;

means for simultaneously supplying water under pressure to an upper portion of each of said cylinder bodies for raising said cylinder bodies on said support leg piston rods and accordingly raising said frame member;

cable means interconnected between all of said support posts for maintaining said frame in a horizontal position and parallel to a line perpendicular to the axis of said piston rods during the raising and lowering of said frame member to prevent the twisting and binding thereof; and said cable means including a first cable connected at one end to an upper piston end portion of a first piston rod and at its opposite end to a lower leg end portion of a second adjacent piston rod, and a second cable connected at one end to an upper piston end portion of said second piston rod and at its opposite end connected to a lower end leg portion of said first piston rod.

11. An improved hydraulically operated boat lift which comprises:

a plurality of support posts;

a lifting frame member supported by said support posts;

means, forming a part of said support posts, for positioning said frame member in a horizontal position;

said support posts each comprising an hydraulic cylinder including a cylinder body secured to said frame member and a downwardly extending piston rod forming a support leg for said frame member;

means for simultaneously supplying water under pressure to an upper portion of each of said cylinder bodies for raising said cylinder bodies on said support leg piston rods and accordingly raising said frame member;

cable means interconnected between all of said support posts for maintaining said frame in a horizontal position and parallel to a line perpendicular to the axis of said piston rods during the raising and lowering of said frame member to prevent the twisting and binding thereof; and latch means connected to said frame member and engaging an opening in a piston rod when said frame is in an up position to lock and hold the frame in such position when the water pressure is released.

12. A boat lift for lifting small boats out of a body of water which comprises:

a lifting frame member for supportably engaging and lifting a boat out of a body of water, said frame member having a plurality of corner portions;

a support post connected to each of said corner portions of said frame member;

each of said corner posts including an upper cylinder body, closed at its upper end, and having a piston therein with a piston rod extending downwardly therefrom;

each said piston rod having adjustable extension leveling means forming leg portions of each support post for engaging a sloping bottom surface of a body of water and for horizontally positioning said frame member over such sloping bottom;

each said cylinder body being vertically moveable on said piston rod and being secured to a corner portion of said lifting frame member so as to move said frame member simultaneously with said cylinder body;

means for simultaneously supplying water under pressure to the closed upper end of each of said cylinder bodies to simultaneously raise each of said cylinder bodies on its respective piston rod and accordingly raise said lifting frame member;

leveling cable means interconnected between the piston rods of adjacent support posts for maintaining said frame member in a level orientation regardless of the weight distribution on each of the support posts during the raising and lowering of said frame so as to prevent the twisting and binding thereof; and each of said piston having an aperture extending therethrough, and said means for supplying water under pressure to the closed upper end of each of said cylinder bodies includes water supply lines connected to the aperture in each of said pistons for simultaneously supplying water to each of said closed upper end portions.

13. A boat lift for lifting small boats out of a body of water which comprises:

a lifting frame member for supportably engaging and lifting a boat out of a body of water, said frame member having a plurality of corner portions;

a support post connected to each of said corner portions of said frame member;

each of said corner posts including an upper cylinder body, closed at its upper end, and having a piston therein with a piston rod extending downwardly therefrom;

each said piston rod having adjustable extension leveling means forming leg portions of each support post for engaging a sloping bottom surface of a body of water and for horizontally positioning said frame member over such sloping bottom;

each said cylinder body being vertically moveable on said piston rod and being secured to a corner portion of said lifting frame member so as to move said frame member simultaneously with said cylinder body;

means for simultaneously supplying water under pressure to the closed upper end of each of said cylinder bodies to simultaneously raise each of said cylinder bodies on its respective piston rod and accordingly raise said lifting frame member;

leveling cable means interconnected between the piston rods of adjacent support posts for maintaining said frame member in a level orientation regardless of the weight distribution on each of the support posts during the raising and lowering of said frame so as to prevent the twisting and binding thereof; and said leveling cable means including a first cable connected at one end to an upper piston end of a first piston rod and at its opposite end to a lower leg end of a second adjacent piston rod, and a second cable connected at one end to an upper piston end of said second piston rod and at its opposite end to a lower leg end of said first piston rod so as to maintain the frame in a level position.

14. A boat lift as defined in claim 13 wherein said leveling means are interconnected between at least three adjacent corner posts.

15. A boat lift for lifting small boats out of a body of water which comprises:

a lifting frame member for supportably engaging and lifting a boat out of a body of water, said frame member having a plurality of corner portions;

a support post connected to each of said corner portions of said frame member;

each of said corner posts including an upper cylinder body, closed at its upper end, and having a piston therein with a piston rod extending downwardly therefrom;

each said piston rod having adjustable extension leveling means forming leg portions of each support post for engaging a sloping bottom surface of a body of water and for horizontally positioning said frame member over such sloping bottom;

each said cylinder body being vertically moveable on said piston rod and being secured to a corner portion of said lifting frame member so as to move said frame member simultaneously with said cylinder body;

means for simultaneously supplying water under pressure to the closed upper end of each of said cylinder bodies to simultaneously raise each of said cylinder bodies on its respective piston rod and accordingly raise said lifting frame member;

leveling cable means interconnected between the piston rods of adjacent support posts for maintaining said frame member in a level orientation regardless of the weight distribution on each of the support posts during the raising and lowering of said frame so as to prevent the twisting and binding thereof; and latch means operatively secured to said frame member and having a nose portion lockably engaging an opening in a piston rod for locking and holding the frame in an up position when the water pressure is released.

16. A boat lift for lifting small boats out of a body of water which comprises:

a lifting frame member for supportably engaging and lifting a boat out of a body of water, said frame member having a plurality of corner portions;

a support post connected to each of said corner portions of said frame member;

each of said corner posts including an upper cylinder body, closed at its upper end, and having a piston therein with a piston rod extending downwardly therefrom;

each said piston rod having adjustable extension leveling means forming leg portions of each support post for engaging a sloping bottom surface of a body of water and for horizontally positioning said frame member over such sloping bottom;

each said cylinder body being vertically moveable on said piston rod and being secured to a corner portion of said lifting frame member so as to move said frame member simultaneously with said cylinder body;

means for simultaneously supplying water under pressure to the closed upper end of each of said cylinder bodies to simultaneously raise each of said cylinder bodies on its respective piston rod and accordingly raise said lifting frame member;

leveling cable means interconnected between the piston rods of adjacent support posts for maintaining said frame member in a level orientation regardless of the weight distribution on each of the support posts during the raising and lowering of said frame so as to prevent the twisting and binding thereof; and a bushing having a keyway attached to each cylinder body, and each said piston rod having a key engaging said keyway to maintain the rotational orientation of said piston rods.

* * * * *